US006739884B2

(12) United States Patent
Vicich et al.

(10) Patent No.: US 6,739,884 B2
(45) Date of Patent: May 25, 2004

(54) ELECTRICAL CONNECTOR HAVING A GROUND PLANE WITH INDEPENDENTLY CONFIGURABLE CONTACTS

(75) Inventors: Brian Vicich, Louisville, KY (US); Edward Messer, New Albany, IN (US)

(73) Assignee: Samtec, Inc., New Albany, IN (US)

( * ) Notice: Subject to any disclaimer, the term of this patent is extended or adjusted under 35 U.S.C. 154(b) by 0 days.

(21) Appl. No.: 09/863,960

(22) Filed: May 23, 2001

(65) Prior Publication Data

US 2004/0009687 A1 Jan. 15, 2004

(51) Int. Cl.[7] ..... H01R 13/648
(52) U.S. Cl. ..... 439/108; 439/608
(58) Field of Search ..... 439/108, 608, 439/607, 620, 628, 630, 636

(56) References Cited

U.S. PATENT DOCUMENTS

| | | | | |
|---|---|---|---|---|
| 4,602,832 | A | 7/1986 | Cunningham et al. | 339/14 |
| 4,718,867 | A | 1/1988 | Seidel et al. | 439/609 |
| 4,975,084 | A | 12/1990 | Fedder et al. | 439/608 |
| 5,141,445 | A | 8/1992 | Little | 439/108 |
| 5,174,770 | A | 12/1992 | Sasaki et al. | 439/108 |
| 5,175,928 | A | 1/1993 | Grabbe | 29/884 |
| 5,261,829 | A | 11/1993 | Fusselman et al. | 439/108 |
| 5,342,211 | A | 8/1994 | Broeksteeg | 439/108 |
| 5,411,415 | A | 5/1995 | Embo et al. | 439/610 |
| 5,429,520 | A | 7/1995 | Morlion | 439/108 |
| 5,429,528 | A | 7/1995 | Longueville et al. | 439/608 |
| 5,456,616 | A | 10/1995 | Fuerst et al. | 439/620 |
| 5,527,740 | A | 6/1996 | Golwalkar et al. | 437/206 |
| 5,542,851 | A | 8/1996 | Chikano | 439/108 |
| 5,549,481 | A | 8/1996 | Morlion et al. | 439/108 |
| 5,586,893 | A | 12/1996 | Mosquera | 439/108 |
| 5,597,326 | A | 1/1997 | DeLessert et al. | 439/608 |
| 5,697,799 | A | 12/1997 | Consoli et al. | 439/181 |
| 5,919,063 | A | 7/1999 | Wang | 439/608 |
| 6,039,583 | A | 3/2000 | Korsunsky et al. | 439/101 |
| 6,089,882 | A | 7/2000 | Costello | 439/95 |
| 6,095,864 | A | 8/2000 | Yu et al. | 439/607 |
| 6,241,531 | B1 * | 6/2001 | Roath et al. | 439/66 |
| 6,273,758 | B1 * | 8/2001 | Lloyd et al. | 439/607 |

* cited by examiner

*Primary Examiner*—Paula A. Bradley
*Assistant Examiner*—Briggitte R. Hammond
(74) *Attorney, Agent, or Firm*—Keating & Bennett, LLP

(57) ABSTRACT

A customizably configurable electrical connector for electrically connecting a plurality of electrically conducting members through at least one electrically conducting ground plate. The ground plate is defined by a plurality of substantially parallel elongated, bendable fingers. Each finger is spaced from every other finger in the ground plate and may be independently bent toward the electrically conducting members to make electrical contact therewith. Preferably, the electrical connector includes a pair of ground plates oriented substantially in parallel, such that the fingers of each ground plate may be bent inwardly towards the opposite ground plate to both electrically and mechanically secure an electrically conducting member therebetween.

45 Claims, 12 Drawing Sheets

ELECTRICAL CONNECTOR HAVING A GROUND PLANE WITH INDEPENDENTLY CONFIGURABLE CONTACTS

TECHNICAL FIELD OF THE INVENTION

The present invention relates generally to electrical connectors and, more particularly, to an electrical connector having a plurality of finger contacts defining a ground plane.

BACKGROUND OF THE INVENTION

Electrical connectors are used to place electrical devices, such as printed circuit boards, in electrical communication with one another. Typically, an electrical connector includes a set of electrical contacts that are adapted to receive a first set of members from the first device to be coupled. The set of contacts extends from the electrical connector and terminates in a second set of members that couple to the second device to be coupled, placing the two devices in electrical communication with each other through the electrical connector.

In order to minimize high frequency noise, it is desirable to provide a ground plane near the electrical contacts in the electrical connector, the ground plane being connected to ground potential. Typically, one or more of the electrical contacts will be coupled to the ground plane. Known electrical connectors are typically provided with certain predetermined electrical contacts connected to the ground plane. Accordingly, unique electrical connectors must normally be provided for each pair of devices to be interconnected.

There is therefore a need for an electrical connector design that allows for customization regarding which pins are grounded and which are not. The present invention is directed towards meeting this need.

SUMMARY OF THE INVENTION

The present invention relates to electrical connector having at least one ground plate adapted to be electrically connected to a ground potential, wherein the ground plate includes a plurality of substantially parallel elongated, bendable fingers. Each finger is spaced from every other finger in the ground plate and may be independently bent inwardly. In one embodiment, the electrical connector also includes a plurality of electrically conducting members or contacts, preferably formed on the edge or surface of a printed circuit board or card. The electrically conducting members are positioned adjacent to the ground plate(s), such that when a ground plate finger is bent inwardly, it can make selective and independent electrical contact with a preselected electrically conducting member. Preferably, the electrical connector includes a pair of ground plates oriented substantially in parallel, such that the fingers of each ground plate may be bent inwardly towards the opposite ground plate to define plurality of electrically interconnected electrically conducting members held firmly by the fingers of the two ground plates.

One object of the present invention is to provide an improved electrical connector device. Related objects and advantages of the present invention will be apparent from the following description.

DETAILED DESCRIPTION OF THE PREFERRED EMBODIMENT

Figure 1:
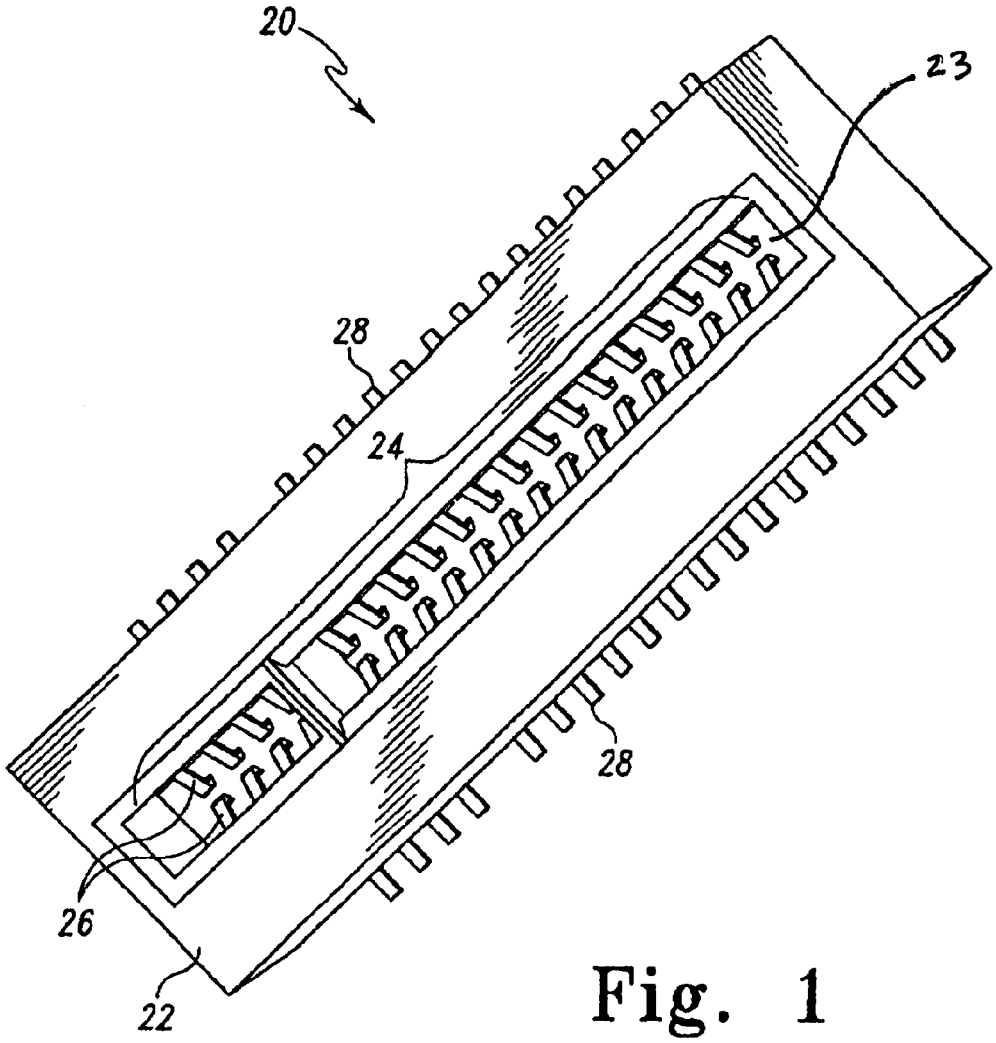
FIG. 1 is a top perspective view of a first embodiment electrical connector of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
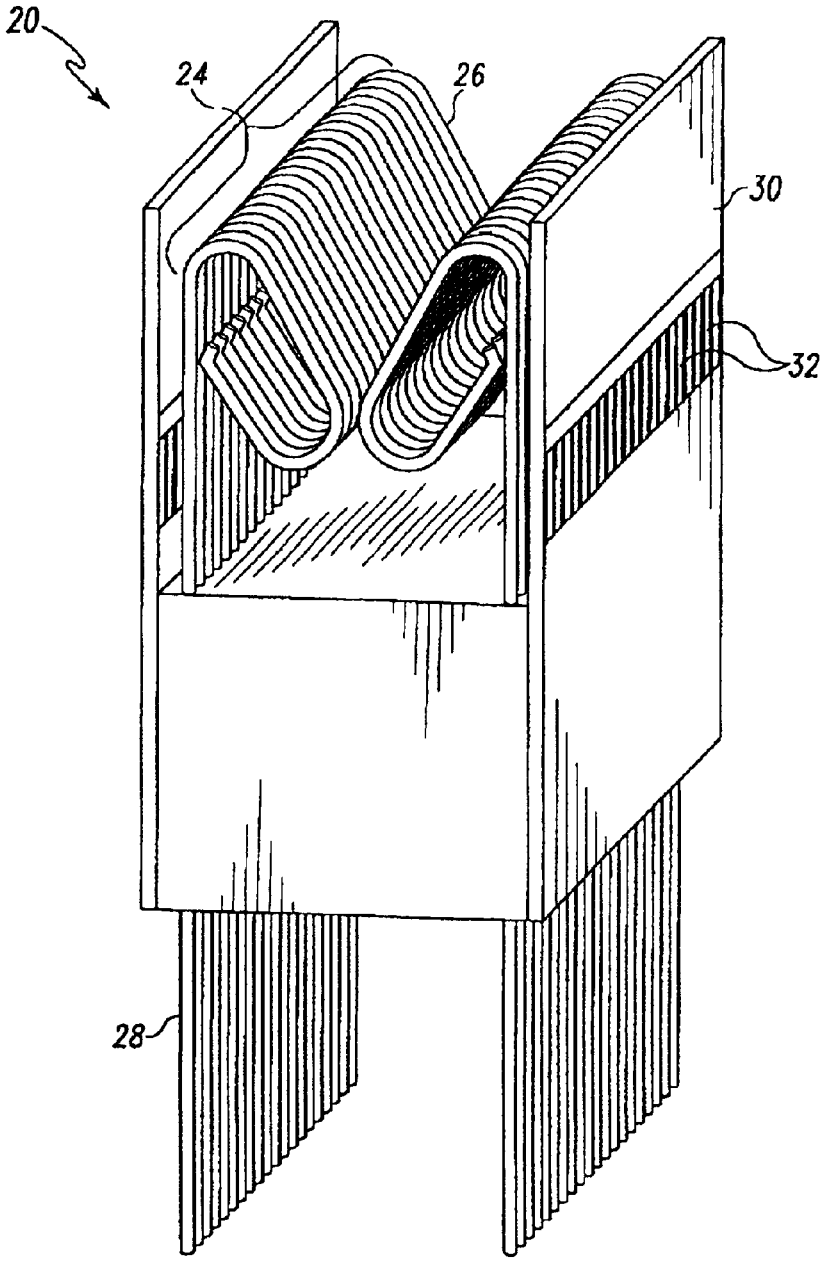
FIG. 2 is a partial side perspective view of the embodiment of FIG. 1, with the housing removed therefrom.
Figure 3:
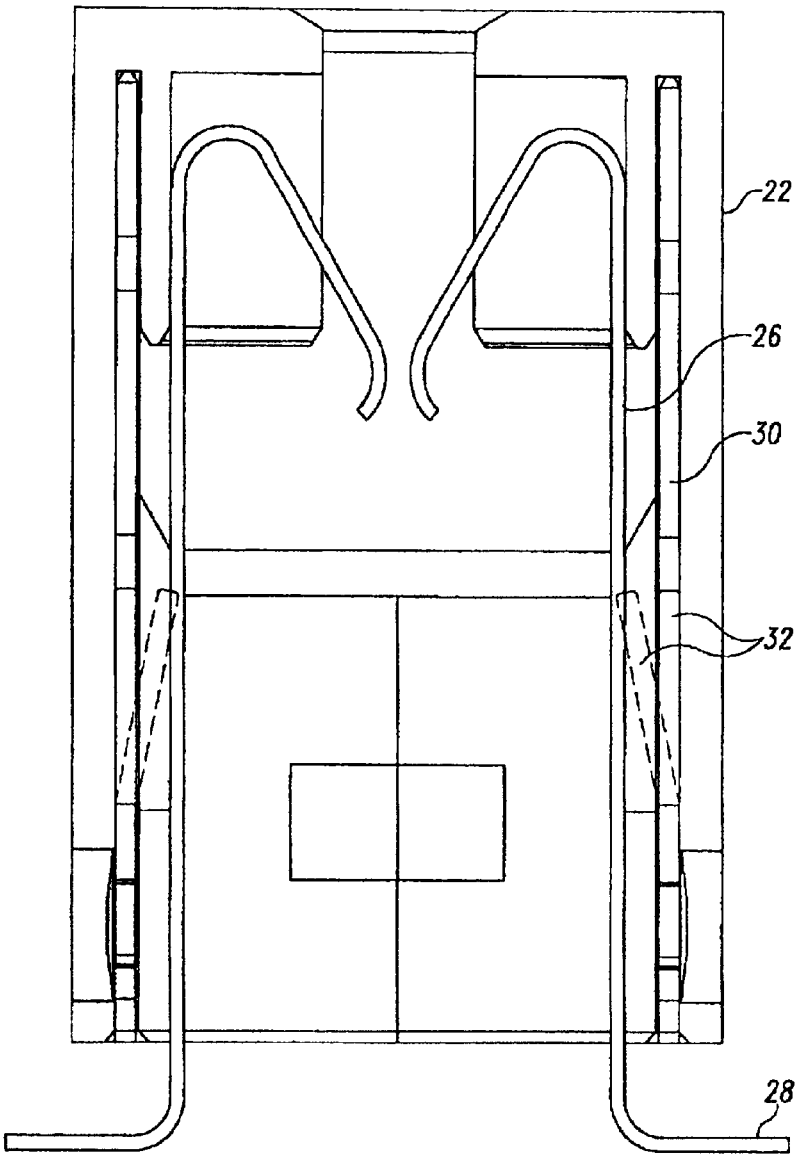
FIG. 3 is a side sectional schematic view of the embodiment of FIG. 1.

FIGS. 1–4A illustrate a first embodiment of the present invention, an edge-type electrical connector 20 for receiving a plurality of electrical contacts and independently configurable to provide any desired pattern of grounding thereto. Referring to FIGS. 1–3, the electrical connector includes a housing portion 22 having a generally open top slot for receiving electrical contacts (generally conductive pads on the edge of a printed circuit board). The housing 22 further contains a plurality of electrical contact receptors or sockets 24 for receiving the individual electrical contacts and holding them in electric communication with a plurality of respective conductors 28. The plurality of electrical contact receptors 24 is generally arranged in a single row, although the plurality of electrical contact receptors 24 could be arranged in two or more parallel rows. As illustrated in FIG. 1, each electrical contact receptor 24 comprises a pair of elongated electrically conducting members 26 positioned opposite each other and having a separation distance therebetween of slightly less that the width of a received contact, such that a contact inserted therebetween would be held in electrical communication with the electrical contact receptor 24 by the spring forces generated by the elastically deflected electrically conducting members 26. While electrical contact receptors 24 comprising multiple pairs of elongated electrically conducting members 26 are preferred, any convenient electrical contact receptor configuration may be selected, such as sockets or the like. The electrical contact receptors 24 terminate in electrical conductors 28 extending from the housing 22. The conductors 28 may be bent away from the housing, if desired (see FIG. 1) or left straight (see FIG. 2).

The housing 22 further includes one or more ground plates 30 positioned therein and oriented substantially parallel to the row of electrical contact receptors 24. FIG. 2 illustrates the connector 20 with the housing 22 removed. The ground plates 30 are formed of an electrically conductive material, such as copper, steel, an alloy, or the like. The ground plates 30 are preferably substantially planar and are more preferably positioned substantially parallel to the row of electrical contact receptors 24. The ground plates 30 include a plurality of individual elongated finger portions 32 formed therein. The finger portions 32 preferably extend parallel to the electrically conducting members 26 and are positioned such that each electrically conducting member 26 is spaced opposite a finger portion 32. In other words, each electrically conducting member 26 and at least one respective finger portion 32 are positioned substantially adjacently, such that the finger portion 32 may be bent sufficiently inwardly toward the electrical conducting member 26 to make electrical contact therewith.

Figure 4A:
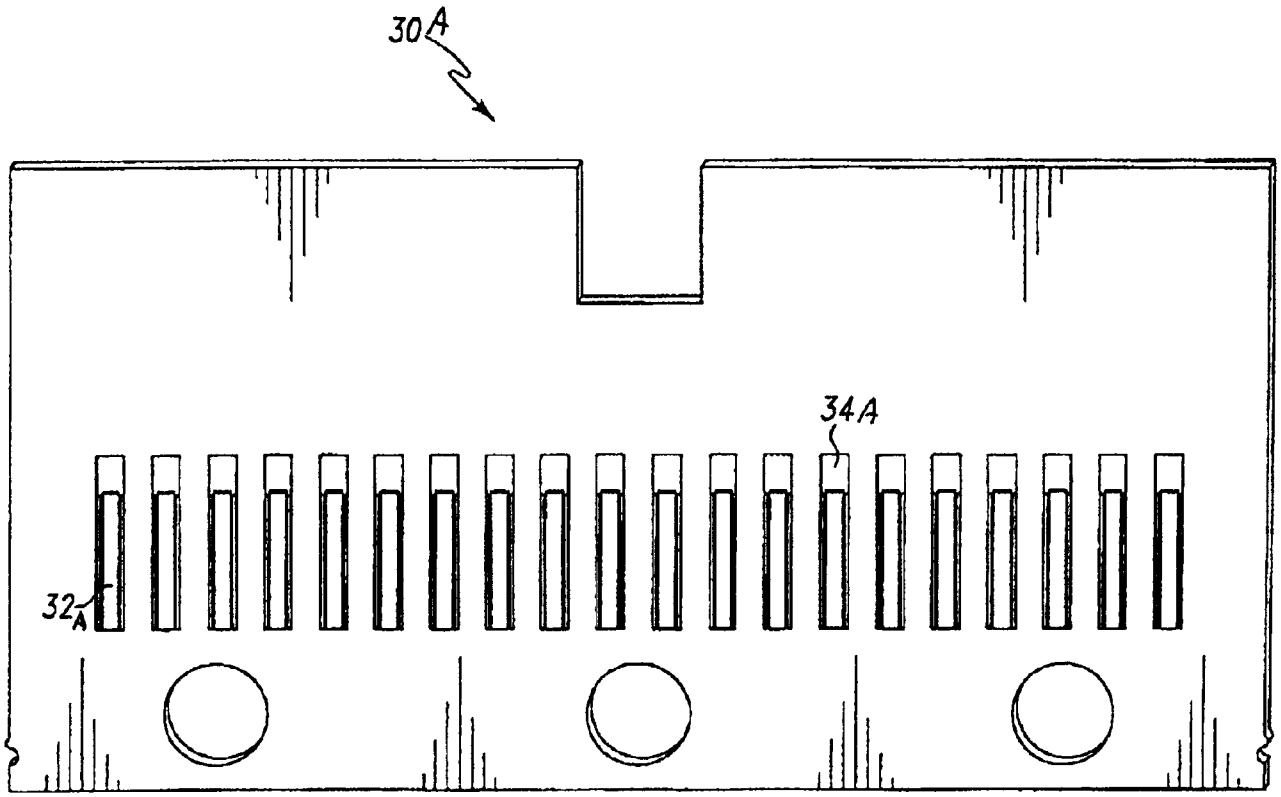
FIG. 4A is a side elevational view of the ground plate of FIG. 2.
Figure 4B:
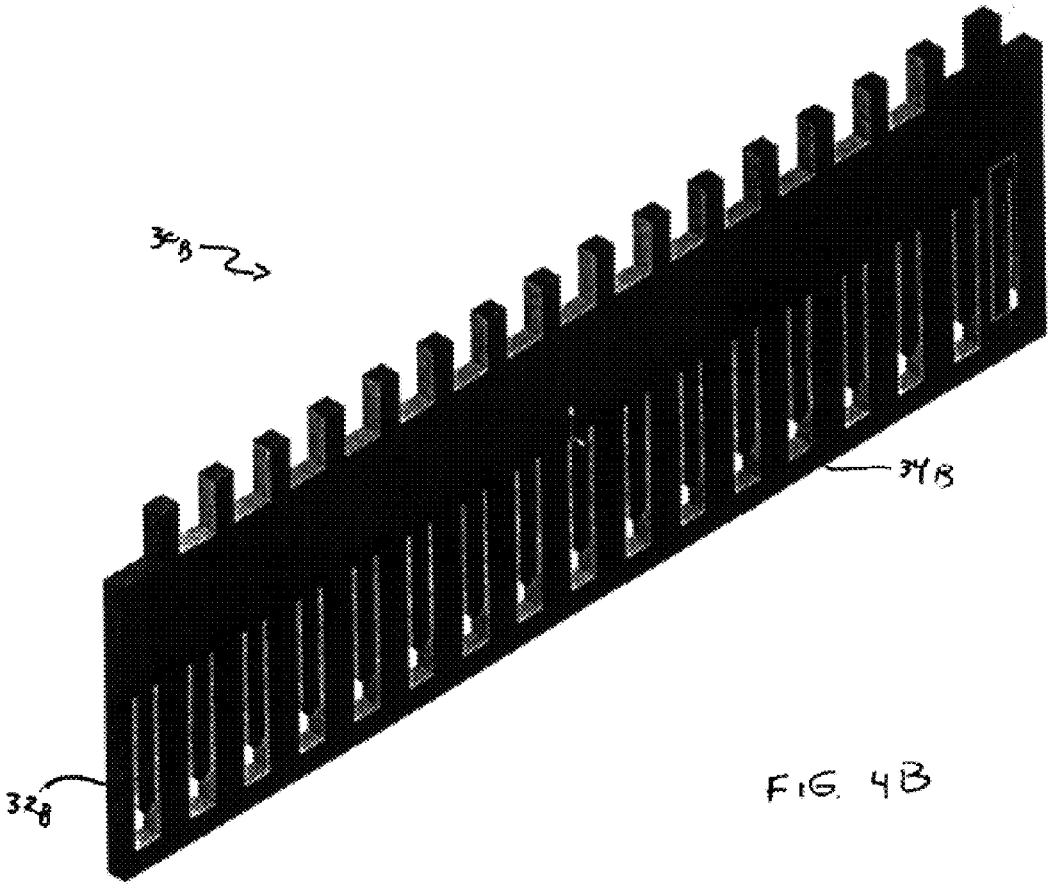
FIG. 4B is a side elevational view of an alternate embodiment ground plate.
Figure 5:
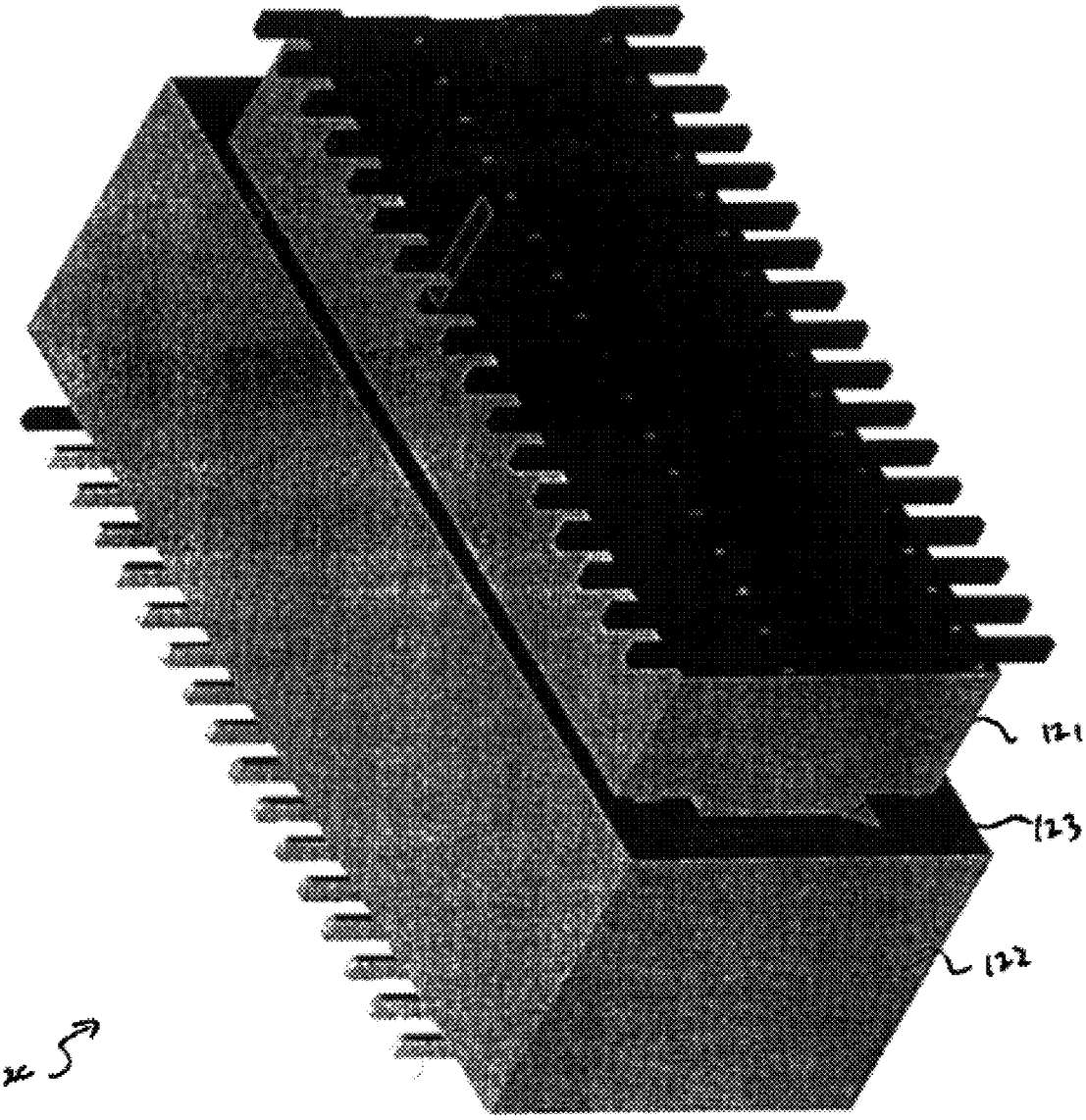
FIG. 5 is a perspective view of a second embodiment electrical connector of the present invention.

Referring to FIGS. 4A and 4B, the ground plates 30 are discussed in greater detail. Each finger portion 32 is preferably defined by a (preferably rectangular) window 34. Each finger portion 32 extends from the ground plate 30 on one side of the window 34 and extends into the window 34 therefrom. The finger portion 32 is preferably an elongated rectangular member extending within the window portion 34 and is more preferably centered therein. The window portions 34 need not be discrete. In other words, the finger portions 32 may be spaced such that there is a gap between each finger portion 32 that is not filled by solid ground plate material. Additionally, the finger portions 32 may be formed with substantially no window portions 34. Referring to the ground plate 30 illustrated in FIG. 4B, the ground plate 30 further includes mounting portions 35 for securely attaching the ground plate 30 to the rest of the electrical connector 20.

The electrical connector 20 is preferably produced with all of the finger portions 32 oriented flush with their respective ground plate 30. In other words, the finger portions 32 are preferably unbent when the electrical connector 20 is produced, although the electric connector 20 may be produced with one or more of the finger portions 32 bent. The electrical connector 20 may therefore be readily modified to have any desired connector ground pin configuration by simply bending the appropriate fingers 32 inwardly to ground the desired electrical contact receptor 24 positions (the bending may be done manually by the end user, mechanically, or during the stamping or forming process). The electrical connector 20 may thusly be customized at any time after production, increasing its utility and flexibility of use. Customization may be done in bulk following manufacture to address a technical requirement. Alternately, the electrical connectors 20 may be sold as manufactured and customized in the field to meet the specific needs of an individual user.

Figure 6:
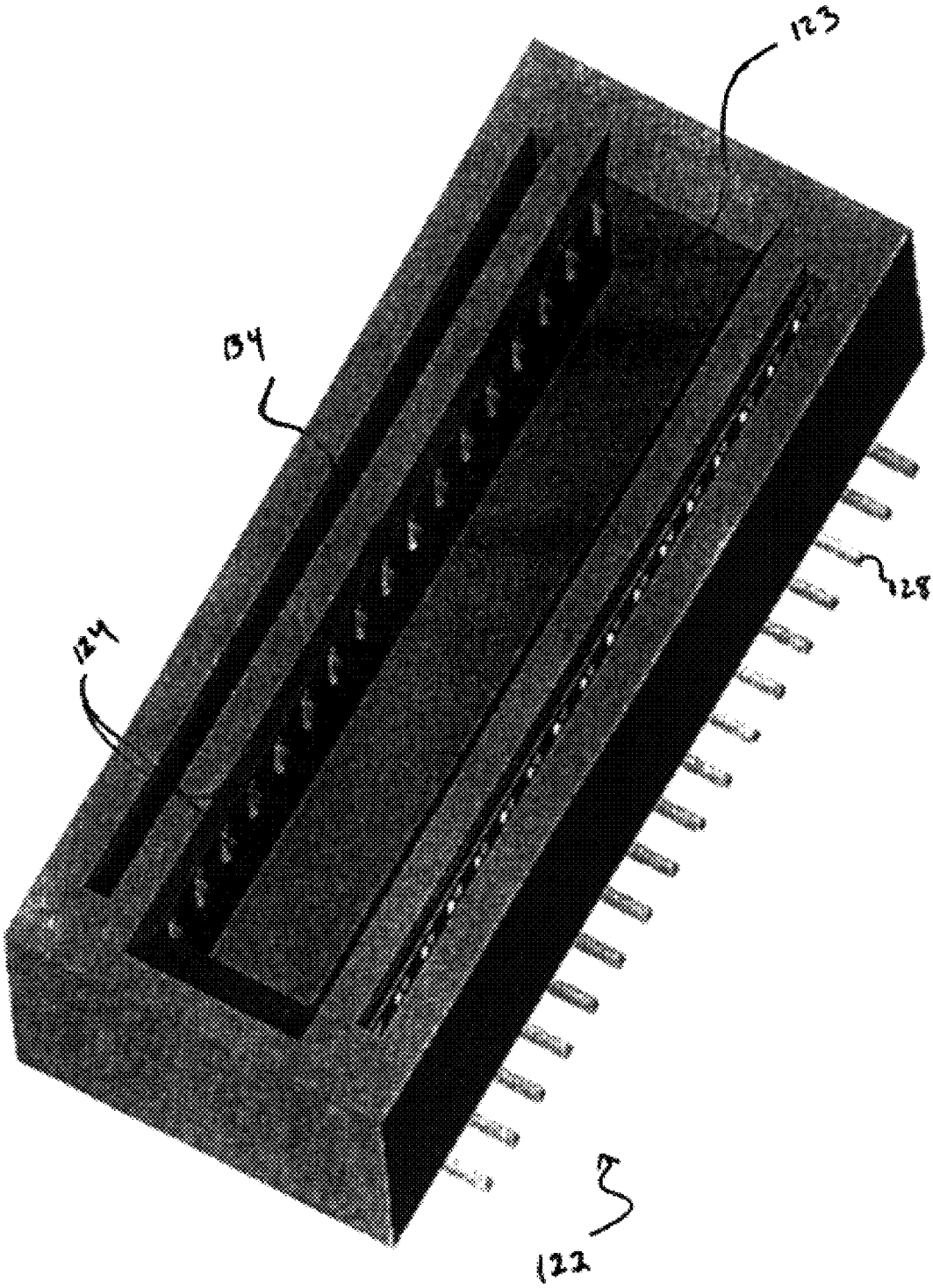
FIG. 6 is a perspective view of a female connector assembly of the electrical connector of FIG. 5.
Figure 7:
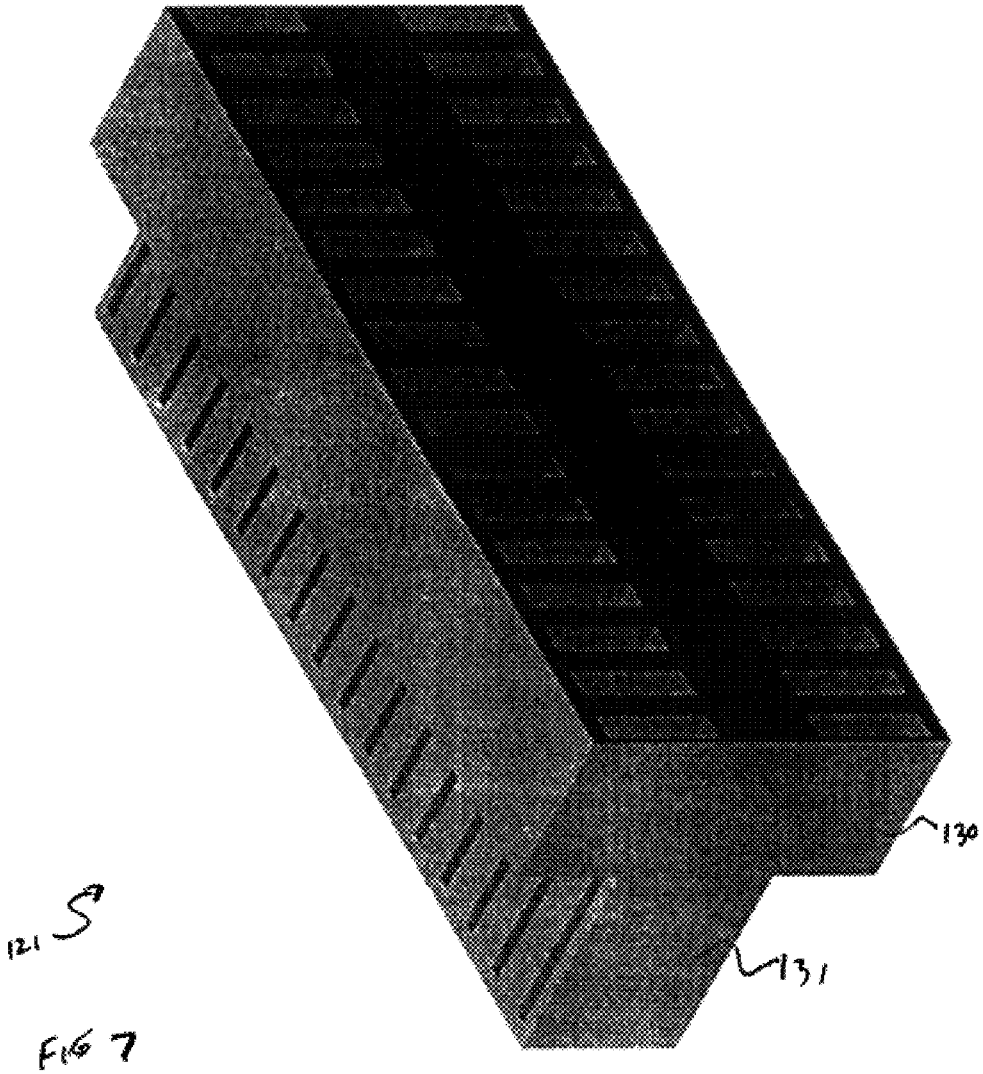
FIG. 7 is a perspective view of a male connector assembly of FIG. 5.
Figure 8:
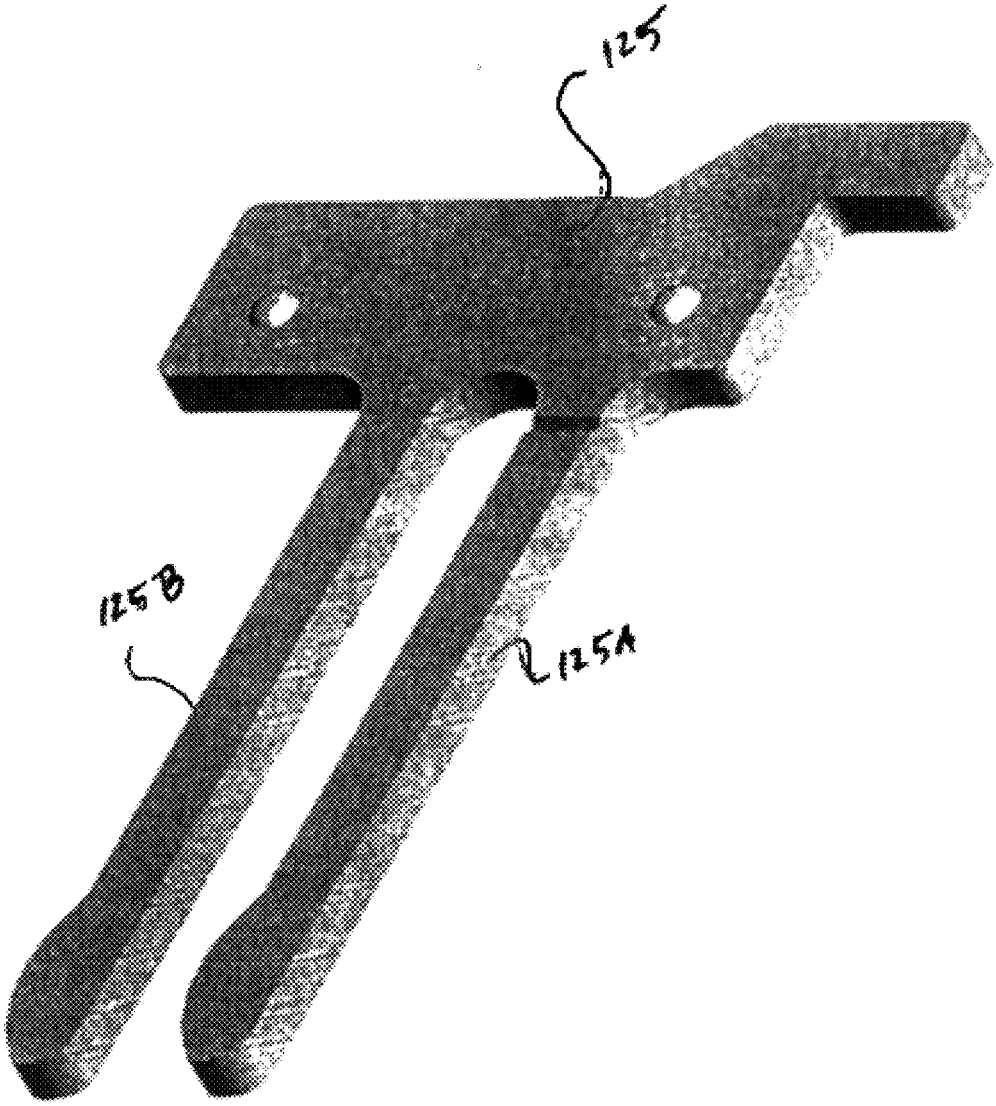
FIG. 8 is a perspective view of an electrical contact used with the male connector assembly of FIG. 7.

FIGS. 5–11 illustrate a second embodiment of the present invention, a board-to-board type electrical connector 120 including a male connector assembly 121 and a female connector assembly 122 adapted to receive the male connector assembly 121 in electric communication. Both housing portions 121, 122 are adapted to receive electrical signals from an attached device. The female connector assembly 122 further includes a pair of independently configurable ground plates 30 adapted to provide any desired pattern of grounding thereto. The electrical connector includes a female connector assembly 122 having a generally open central slot 123 for receiving the compatible male connector assembly 121 in electrical communication. The central slot 123 further includes a plurality of electrical contact receptors 124 positioned therein. The male connector assembly 121 includes a plurality of sequentially disposed electric contacts 125. These electric contacts 125 are typically disposed as two rows, one on either elongated side of the male connector assembly 121. Further, each male electric contact 125 preferably has two elongated prongs 125A and 125B extending therefrom, as is illustrated in FIG. 8.

As noted above, the female connector assembly 122 includes a plurality of electrical contact receptors or sockets 124 for receiving the first elongated prongs 125B of the male electrical contacts 125 in electric communication. The plurality of electrical contact receptors 124 is generally arranged one or more rows to match the rows of electric contacts 125 on the male connector assembly 121. However, the male electric contacts 125 and the female electric contact receptors 124 could be disposed according to any convenient geometry.

Figure 9:
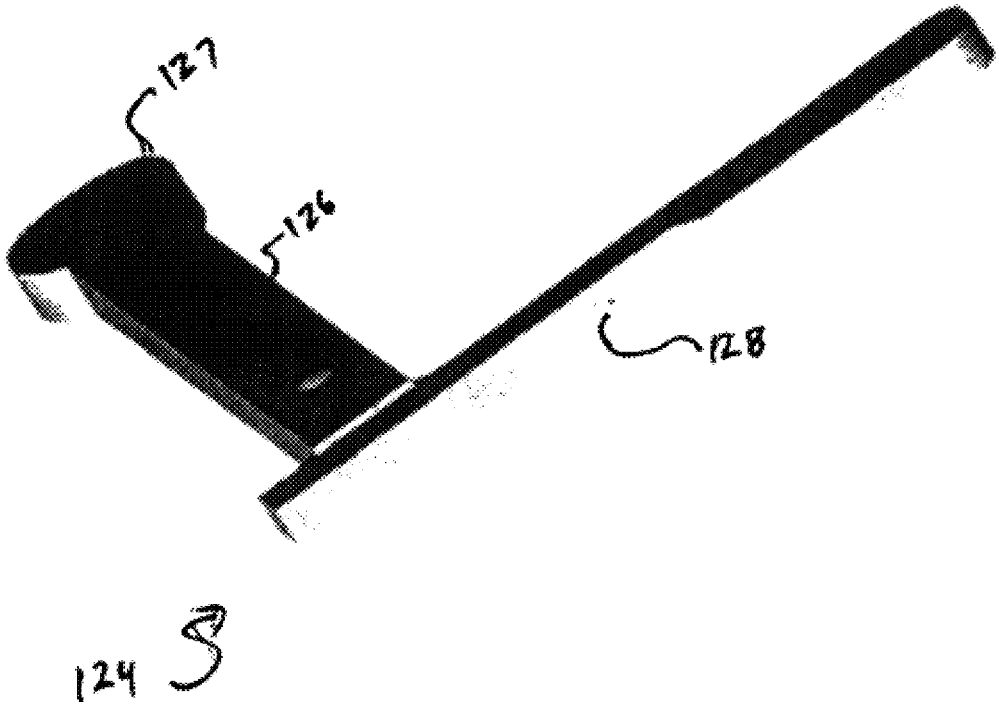
FIG. 9 is a perspective view of a female electrical contact receptor used with the female connector assembly of FIG. 6.

As illustrated in FIG. 9, each electrical contact receptor 124 comprises an elongated electrically conducting member 126 having a rounded contact tip 127 extending therefrom. The elongated electrically conducting member is adapted to extend into the female connector assembly 122 with the rounded contact tip protruding into the slot 123. A first elongated prong 125B of a male electric contact 125 positioned on a male connector assembly 121 inserted into the female connector assembly 122 would be held in electrical communication with the electrical contact receptor 124, as shown in FIG. 6. The electrical contact receptor 124 also includes a second elongated portion 128 adapted to extend from the female connector assembly 122 for electrical connection to a device, such as a printed circuit board.

Figure 10:
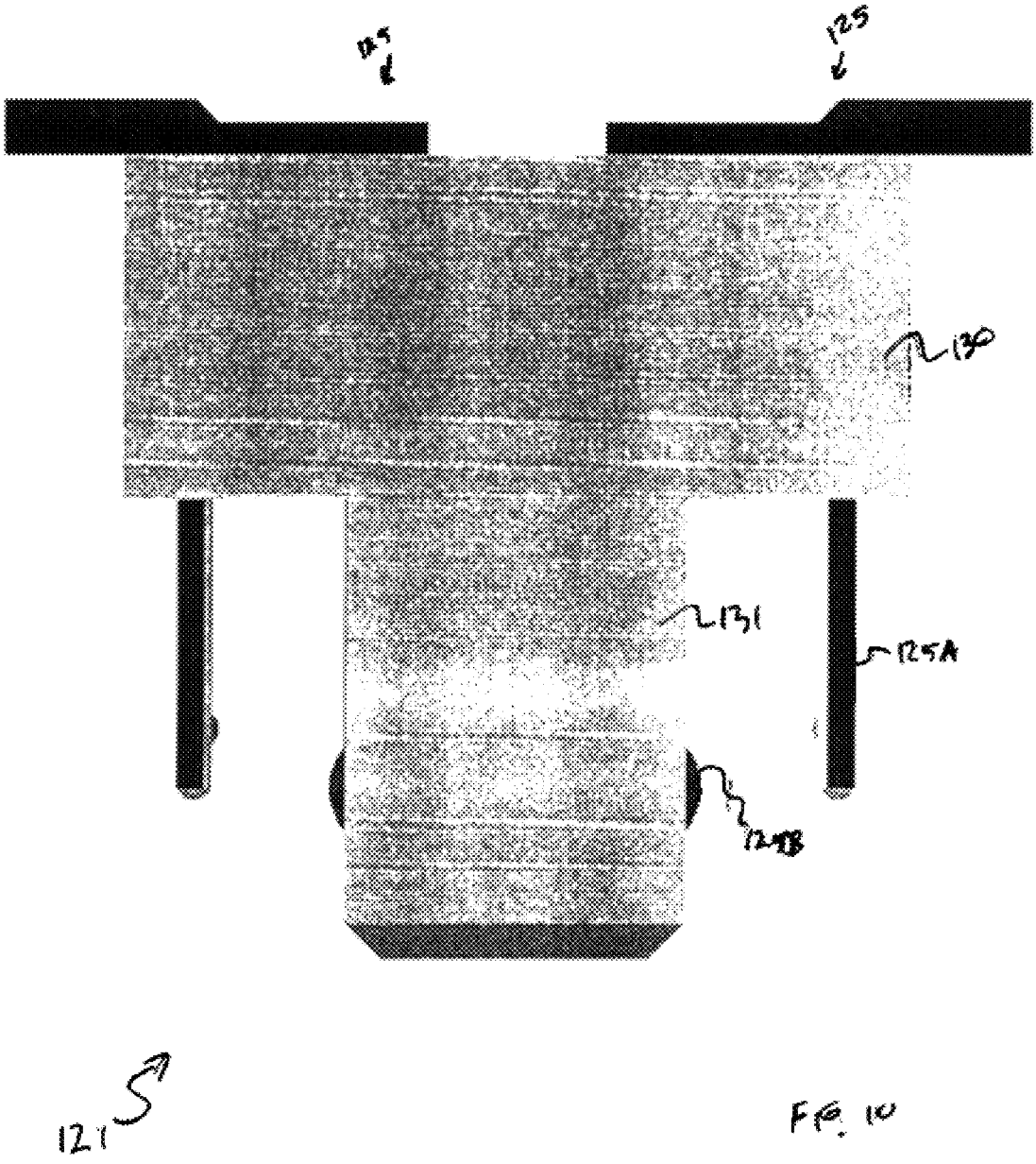
FIG. 10 is an end elevational view of the male connector assembly of FIG. 7 including the electrical contact of FIG. 8.

As shown in FIG. 7, the male connector assembly preferably has a T-shaped cross-section with a top bar portion 130 and an elongated portion 131 adapted to extend into the central slot 123 when the male connector assembly 121 is joined with the female connector assembly 122. As shown in FIG. 10, the electrical contacts 125 are inserted into the male connector assembly 121 such that the first elongated prong 125B extends through the elongated portion 131 and at least partially protrudes therefrom. The second elongated prong 125A extends through the top bar portion 130.

Figure 11:
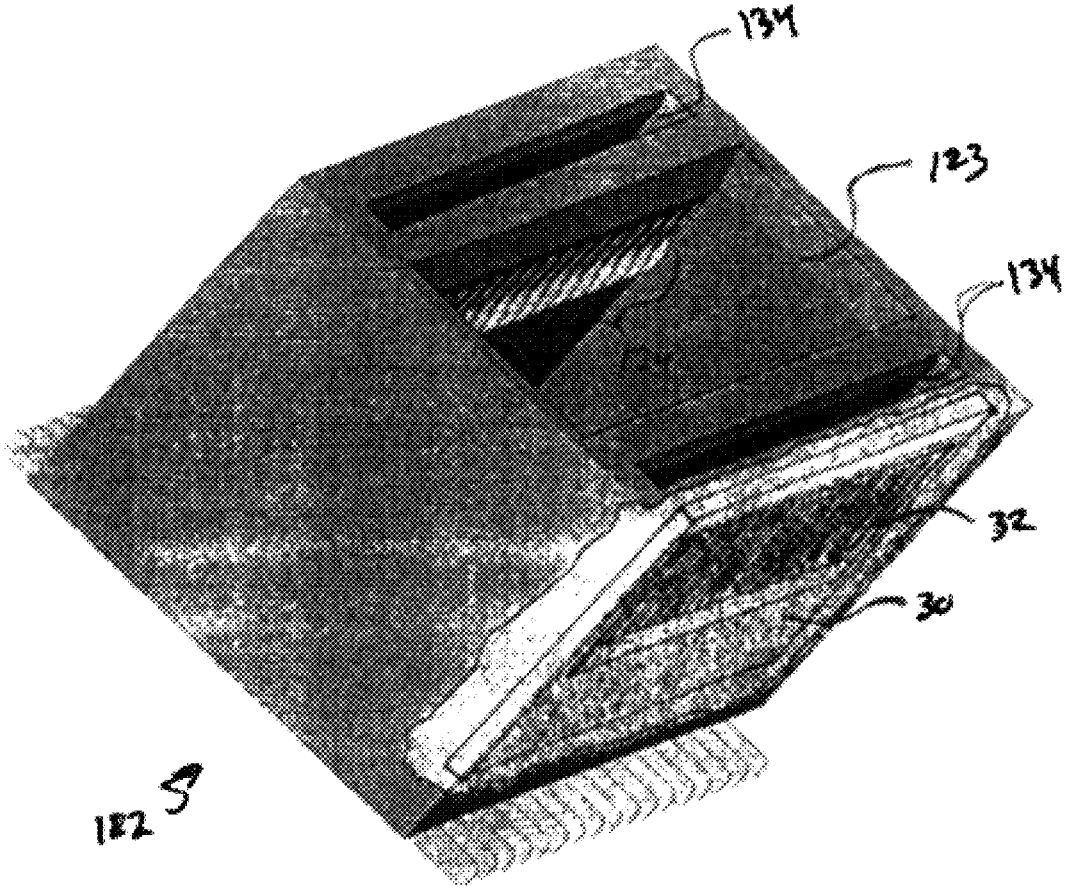
FIG. 11 is a partial sectional view of the female connector assembly of FIG. 6 showing the placement of a ground plate therein.

As illustrated in FIG. 11, the female connector assembly 122 further includes one or more ground plates 30 positioned adjacent one or more grounding slots 134 formed therein. As discussed above and shown in FIGS. 4A and 4B, the ground plates 30 are made of an electrically conducting material, such as copper or steel. The ground plates 30 include a plurality of individual elongated finger portions 32 formed therein. Each ground plate 30 is oriented such that the fingers 32 are substantially adjacent and spaced from the second elongated prongs 125B when the male and female connector assemblies 121, 122 are mated. The finger portions 32 preferably extend parallel to the first elongated prongs 125A and are positioned such that each first elongated prong 125A of a male electrical contact 125 on a male connector assembly 121 inserted into the female connector assembly 122 is spaced opposite a finger portion 32. In other words, each male first elongated prong 125A and at least one respective finger portion 32 are positioned substantially adjacently, such that the finger portion 32 may be bent sufficiently inwardly toward the male second first prong 125A to make electrical contact therewith. Since the ground plate 30 is electrically grounded, contact by a male first elongated prong 125A with a finger portion 32 will electrically ground the associated male second elongated prong 125B, any electrical receptor 124 in contact with the associated male second elongated prong 125B, as well as any device electrically connected thereto.

As with the electrical connector 20 embodiment discussed above, the electrical connector 120 is preferably produced with all of the finger portions 32 oriented flush with their respective ground plate 30, i.e., unbent, although the electric connector 120 may be produced with one or more of the finger portions 32 bent. The electrical connector 120 may therefore be readily modified to have any desired connector ground pin configuration by simply bending the appropriate fingers 32 inwardly to ground the desired male electrical contact 121 positions (the bending may be done manually by the end user, mechanically, or during the stamping or forming process). The electrical connector 120 may thusly be customized at any time during or after production, increasing its utility and flexibility of use. Customization may be done in bulk following manufacture to address a technical requirement. Alternately, the electrical connectors 120 may be sold as manufactured and customized in the field to meet the specific needs of an individual user.

In operation, predetermined fingers 32 are urged into electrical contact with pre-selected electrically conducting members 26 (or male electrical contacts 125), thereby electrically connecting pre-selected contact receptors 24/contacts 125 to a common ground plate 30. Which contact receptors 24/contacts 125 are grounded to the ground plate 30 is predetermined according to the configuration of the device or devices to be mated to the electrical connector 20/120. In other words, the end user determines which contact receptors 24/contacts 125 are to be connected to the ground plate 30 based on the wiring of the device connected to the electrical connector 20/120. Electrical contacts (not shown) extending from the device(s) are electrically connected to the electrical connector 20; those contacts received by electrical connector such that they are ultimately in electric communication with the fingers 32 urged are thusly grounded by the ground plate 30.

Preferably, two ground plates 30 are provided and oriented in parallel, such that each respective finger 32 of each ground plate 30 is paired with an opposite respective finger 32 of the other ground plate 30. The fingers 32 are spaced a finite, non-zero distance apart sufficient to accommodate the placement of a conductor partially filling the space in between the fingers 32. In other words, there is sufficient room between the unbent fingers 32 for the insertion of at least one electrically conducting member therebetween such that the neither finger 32 electrically contacts the electrically conducting member. The fingers 32 may be plastically deformed (i.e., bent) towards one another such that at least one finger 32 electrically connects with an electrically conducting member, such as an electrical contact receptor 124 or an electric contact 125, positioned therebetween and desired to be grounded. However, other designs are contemplated having only a single ground plate 30 or multiple asymmetrically disposed ground plates 30.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. An electrical connector, comprising:

a plurality of electrically conducting members;

a first electrically conducting plate; and a second electrically conducting plate positioned opposite to and oriented substantially in parallel with the first electrically conducting plate; and a first and second plurality of substantially parallel elongated electrically conducting fingers;

wherein each of the first and second plurality of fingers is capable of being independently and selectively manipulated such that some of the first and second plurality of fingers electrically connect a respective one of the first and second electrically conducting plates to a corresponding one of the plurality of electrically conducting members and others of the first and second plurality of fingers do not electrically connect a respective one of the first and second electrically conducting plates to a corresponding one of the plurality of electrically conducting members.

2. The connector of claim 1, wherein each of the first plurality of fingers is disposed in the first electrically conducting plate and is positioned substantially opposite to a respective finger of the second plurality of fingers which are disposed in the second electrically conducting plate.

3. The connector of claim 1, further comprising a plurality of electrically conducting contact receptors positioned between and spaced from the first and second electrically conducting plates, wherein each one of the plurality electrically conducting contact receptors is positioned between two oppositely disposed fingers of the first and second plurality of fingers, and at least one finger of the first and second plurality of fingers is bent towards the opposite electrically conducting plate to make electrical contact with a respective electrically conducting contact receptor to grounds the respective electrically conducting plate connected thereto.

4. The connector of claim 1, wherein said some of the first and second plurality of fingers that electrically connect a respective one of the first and second electrically conducting plates to a corresponding one of the plurality of electrically conducting members are bent towards the corresponding one of the plurality of electrically conducting members to make electrical contact with a ground potential.

5. The connector of claim 1, wherein the first and second plurality of fingers are adapted to be selectively bent inwardly towards the opposite electrically conducting plate.

6. The connector of claim 1 wherein at least some of the fingers are selectively bent inwardly towards the oppositely positioned electrically conducting plate to produce a customized pattern of grounded electrical contacts.

7. The connector of claim 1, wherein each of the first and second substantially planar electrically conducting plates is electrically connectable to a ground potential.

8. The connector of claim 7, wherein each of the first and second substantially planar electrically conducting plates is electrically connected to a ground potential.

9. An electrical connector device, comprising:

a housing;

a plurality of electrically conducting fingers in electrical communication with a ground potential; and a plurality of electrically conducting members extending at least partially into the housing;

wherein each of the plurality of fingers is arranged to be selectively and independently plastically deformed such that a first group of the plurality of fingers are electrically connected to a respective one of the plurality of electrically conducting members and a second group of the plurality of fingers are not electrically connected to a respective one of the plurality of electrically conducting members.

10. The device of claim 9, wherein the plurality of electrically conducting fingers are arranged to define finger pairs disposed opposite to each other, and each of the finger pairs includes a first elongated electrically conducting finger spaced from a second elongated electrically conducting finger.

11. The device of claim 9, wherein plastic deformation of said first group of the plurality of fingers that are electrically connected to a respective one of the plurality of electrically conducting members causes said first group of fingers to be bent towards and to physically contact said respective one of the plurality of electrically conducting members.

12. An electrical connector apparatus, comprising:

a housing adapted to receive electrically conducting members;

a plurality of spaced electrically conducting members extending into the housing; and a plurality of elongated electrically conducting fingers in electrical communication with one another and with a ground potential;

wherein the electrically conducting fingers are positioned such that each of the plurality of electrically conducting members is substantially opposite a respective one of the first plurality of elongated electrically conducting fingers; and wherein each respective one of the plurality of elongated electrically conducting fingers positioned opposite one of the plurality of spaced electrically conducting members may be independently and selectively positioned such that a first group of the plurality of fingers are electrically connected to a respective one of the plurality of electrically conducting members and a second group of the plurality of fingers are not electrically connected to a respective one of the plurality of electrically conducting members.

13. The apparatus of claim 12, wherein the plurality of elongated electrically conducting fingers includes a first and a second plurality of elongated electrically conducting fingers in electrical communication with the ground potential, wherein each finger of the second plurality of elongated electrically conducting fingers is positioned substantially opposite to a respective finger of the first plurality of elongated fingers, and wherein each of the plurality of electrically conducting members is positioned between two of the elongated fingers.

14. The apparatus of claim 12 wherein the electrically conducting members are adapted to be coupled to the surface of a printed circuit board.

15. An electrical connector device, comprising:

a female connector assembly; and a male connector assembly insertible into the female connector assembly;

wherein the female connector assembly further comprises:

a central slot;

a plurality of electrically conducting contact receptors sequentially positioned within the slot and extending beyond the female connector assembly;

at least one grounding slot; and an electrically conducting ground plate having a plurality of bendable electrically conducting fingers formed therein;

wherein the ground plate is electrically connected to a ground potential;

wherein the male connector assembly further comprises:

an elongated central portion adapted for insertion into the central slot;

a plurality of electrically conducting electrical contacts, each contact having a first elongated prong and a second elongated prong; and at least one elongated grounding portion adapted for insertion into the grounding slot;

wherein the plurality of first elongated prongs are positioned to at least partially extend through the elongated central portion;

wherein each of the plurality of first elongated prongs is positioned to electrically communicate with a respective electrical contact receptor upon insertion of the elongated central portion into the central slot;

wherein the plurality of second elongated prongs are positioned to extend at least partially through the elongated grounding portion; and wherein each second elongated prong is positioned substantially adjacent to and spaced from a respective bendable electrically conducting finger; and wherein bending a respective bendable electrically conducting finger into contact with a respective second elongated prong actuates electric communication between the ground plate and a respective electrically conducting electrical contact, including the respective first elongated prong and anything in electrical communication therewith.

16. A method for producing an electrical connector, comprising the steps of:

a) providing a plurality of electrically conducting members disposed opposite to each other;

b) providing at least two of ground plates disposed opposite to each other;

c) providing a plurality of electrically conducting elongated fingers at a position such that the plurality of electrically conducting elongated fingers are capable of electrically connecting one of the plurality of electrically conducting members with one of the at least two ground plates; and d) processing individual ones of the plurality of elongated fingers such that each of a first group of the plurality of elongated fingers electrically connects one of the plurality of electrically conducting members with one of the at least two ground plates and each of a second group of the plurality of elongated fingers does not electrically connect one of the plurality of electrically conducting members with one of the at least two ground plates.

17. The method of claim 16, wherein step d) includes the step of selecting the individual ones of the electrically conducting members to be connected electrically to one of the ground plates via the first group of the plurality of elongated fingers.

18. The method of claim 17 wherein step d) is performed by an end user.

19. The method of claim 17 wherein step d) is performed by a manufacturer.

20. The method of claim 17, wherein step d) further comprises the step of bending the first group of the plurality of elongated fingers into electrical communication with one of the plurality of electrically conducting members.

21. The method of claim 17, wherein the step d) further comprises the step of modifying the position of the first group of the plurality of elongated fingers.

22. The method of claim 17, wherein the step d) further comprises the step of modifying the position of the first group of the plurality of elongated fingers relative to the at least two ground plates.

23. The method of claim 17, wherein the step d) further comprises the step of modifying the position of the first group of the plurality of elongated fingers relative to the plurality of electrically conducting members.

24. The method of claim 17, wherein the step d) further comprises the step of deforming the first group of the plurality of elongated fingers.

25. The method of claim 17, wherein the plurality of elongated fingers are arranged in a first pattern prior to step d) and are arranged in a second pattern that is different from the first pattern after step d).

26. An electrical connector, comprising:

a first and second plurality of electrically conducting members disposed opposite to each other;

at least two ground plates disposed opposite to each other;

a first and second plurality of elongated electrically conducting fingers arranged to be capable of electrically connecting one of the at least two ground plates and one of the first and second plurality of electrically conducting members; wherein the first and second plurality of elongated electrically conducting fingers are arranged to be selectively and independently processed to product a customized pattern of grounded contacts such that a first group of the elongated fingers electrically connect one of the plurality of electrically conducting members with one of the at least two ground plates and a second group of the elongated fingers do not electrically connect one of the plurality of electrically conducting members with one of the at least two ground plates.

27. An electrical connector according to claim 26, the first and second plurality of elongated electrically conducting fingers are capable of being bent so as to electrically connect one of the plurality of electrically conducting members with one of the at least two ground plates.

28. An electrical connector according to claim 26, wherein the first and second plurality of elongated electrically conducting fingers are capable of being moved so as to electrically connect one of the plurality of electrically conducting members with one of the at least two ground plates.

29. An electrical connector according to claim 26, wherein the first and second plurality of elongated electrically conducting fingers are capable of being moved relative to the plurality of electrically conducting members.

30. An electrical connector according to claim 26, wherein the first and second plurality of elongated electrically conducting fingers are capable of being moved relative to the at least two ground plates.

31. An electrical connector according to claim 26, wherein the first and second plurality of elongated electrically conducting fingers are capable of being plastically deformed.

32. An electrical connector, comprising:

an insulated housing;

first and second rows of electrically conducting members disposed opposite to each other and within the housing;

at least two electrically conductive plates disposed opposite to each other on opposite surfaces of the insulated housing; wherein a first group of the first and second rows of electrically conducting members are electrically connected to one of the at least two electrically conductive plates and a second group of the first and second rows of electrically conducting members are not electrically connected to either of the at least two electrically conductive plates.

33. An electrical connector according to claim 32, wherein the at least two electrically conductive plates are ground plates which are electrically connected to ground.

34. An electrical connector according to claim 32, wherein the second group of the first and second rows of electrically conducting members which are not electrically connected to either of the at least two electrically conductive plates are arranged to transmit signals through the connector.

35. An electrical connector according to claim 32, wherein the at least two electrically conductive plates are disposed on opposite outer surfaces of the insulated housing.

36. An electrical connector according to claim 32, wherein the first group of the first and second rows of electrically conducting members are electrically connected to one of the at least two electrically conductive plates at an outer surface of the insulated housing.

37. An electrical connector according to claim 32, further comprising a plurality of elongated electrically conductive fingers, wherein the first group of the first and second rows of electrically conducting members are electrically connected to the one of the at least two electrically conductive plates via the plurality of elongated electrically conductive fingers.

38. An electrically connector according to claim 37, wherein the plurality of fingers are arranged to contact a surface of the one of the at least two electrically conductive plates.

39. An electrical connector, comprising:

an insulated housing;

first and second rows of electrically conducting members disposed opposite to each other and within the housing;

a first group of the first and second rows of electrically conducting members are electrically connected to ground at an outer portion of the insulated housing and a second group of the first and second rows of electrically conducting members are not electrically connected to ground and are arranged to transmit signals through the connector.

40. An electrical connector according to claim 39, further comprising first and second ground plates disposed at the outer portion of the insulated housing, each of the first and second ground plates being electrically connected to one member of the first group of the first and second rows of electrically conducting members.

41. An electrical connector according to claim 40, wherein the first and second ground plates are disposed on opposite outer surfaces of the insulated housing.

42. An electrical connector according to claim 39, wherein the first group of the first and second rows of electrically conducting members are electrically connected to ground at different locations along two opposite outer surfaces of the insulated housing.

43. An electrical connector according to claim 39, wherein each member of the first group of the first and second rows of electrically conducting members is electrically connected to one of the first and second ground plates at a middle portion of the one of the first and second ground plates.

44. An electrical connector according to claim 39, further comprising a plurality of elongated electrically conductive fingers, wherein the first group of the first and second rows of electrically conducting members are electrically connected to ground via the plurality of elongated electrically conductive fingers.

45. An electrically connector according to claim 44, further comprising first and second ground plates disposed at the outer portion of the insulated housing and each of the first and second ground plates being electrically connected to one member of the first group of the first and second rows of electrically conducting members, wherein each of the plurality of fingers is arranged to contact a surface of one of the first and second ground plates.

* * * * *

UNITED STATES PATENT AND TRADEMARK OFFICE

CERTIFICATE OF CORRECTION

PATENT NO. : 6,739,884 B2
DATED : May 25, 2004
INVENTOR(S) : Brian Vicich et al.

It is certified that error appears in the above-identified patent and that said Letters Patent is hereby corrected as shown below:

Column 6,
Line 33, “grounds” should read -- ground --.
Line 45, “claim 1 wherein” should read -- claim 1, wherein --.

Column 9,
Line 25, “product” should read -- produce --.

Signed and Sealed this

Eighteenth Day of October, 2005

JON W. DUDAS
*Director of the United States Patent and Trademark Office*